US007441772B2

(12) United States Patent
Kawashima et al.

(10) Patent No.: US 7,441,772 B2
(45) Date of Patent: Oct. 28, 2008

(54) SHEET-CONVEYING DEVICE

(75) Inventors: Hideki Kawashima, Yokohama (JP); Hitoshi Nishitani, Ohta-Ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 282 days.

(21) Appl. No.: 11/376,822

(22) Filed: Mar. 16, 2006

(65) Prior Publication Data

US 2006/0214363 A1 Sep. 28, 2006

(30) Foreign Application Priority Data

Mar. 22, 2005 (JP) ..... 2005-080776

(51) Int. Cl.
*B65H 1/22* (2006.01)

(52) U.S. Cl. ..... 271/251; 271/250; 271/248; 271/226

(58) Field of Classification Search ..... 271/251, 271/253, 254, 250, 248, 234, 236, 239, 226, 271/240, 243, 244, 255; 347/107
See application file for complete search history.

(56) References Cited

U.S. PATENT DOCUMENTS 4,266,762 A * 5/1981 Kramer et al. ..... 271/225
4,668,961 A 5/1987 Hiramatsu et al.
4,676,498 A * 6/1987 Kanemitsu et al. ..... 271/251
5,083,879 A * 1/1992 Sato et al. ..... 400/579
5,120,047 A * 6/1992 Mandel et al. ..... 271/220
5,162,857 A * 11/1992 Higeta et al. ..... 399/401
5,169,140 A * 12/1992 Wenthe, Jr. ..... 271/228
5,253,862 A * 10/1993 Acquaviva et al. ..... 271/251
5,742,318 A * 4/1998 Miyauchi et al. ..... 347/134
6,329,108 B1 * 12/2001 Fujiike et al. ..... 430/7
6,561,504 B2 * 5/2003 Mlejnek et al. ..... 270/58.12
6,965,458 B2 * 11/2005 Sato et al. ..... 358/401
2006/0070840 A1 * 4/2006 Hayashi et al. ..... 194/206

FOREIGN PATENT DOCUMENTS

JP 58139944 * 8/1983
JP 58183550 * 10/1983
JP 58216852 * 12/1983
JP 60102351 * 6/1985
JP 02039968 2/1990

(Continued)

*Primary Examiner*—Patrick Mackey
*Assistant Examiner*—Patrick D Cicchino
(74) *Attorney, Agent, or Firm*—Canon USA Inc IP Div

(57) ABSTRACT

A sheet-conveying device includes a sheet conveying path along which a sheet is conveyed, a conveying roller, an inclined roller, an inclined-roller-supporting member that supports the inclined roller such that the inclined roller can rotate around a rotational axis that is inclined with respect to a rotational axis of the conveying roller, and a sheet contact member having a contact surface with which an edge portion of the sheet comes into contact. The inclined-roller-supporting member moves between a position where the inclined roller comes into pressure contact with the conveying roller and a position where the inclined roller is separated from the conveying roller. The sheet contact member moves between a position where the edge portion of the sheet can come into contact with the contact surface and a position where the contact surface cannot restrict the position of the edge portion of the sheet.

8 Claims, 7 Drawing Sheets

FOREIGN PATENT DOCUMENTS

| | | | | |
|---|---|---|---|---|
| JP | 5-213487 | A | | 8/1993 |
| JP | 7-334630 | A | | 12/1995 |
| JP | 8-208075 | A | | 8/1996 |
| JP | 2000-326531 | A | | 11/2000 |
| JP | 2002362785 | | | 12/2002 |
| JP | 2002362785 | A | * | 12/2002 |
| JP | 2003165652 | | | 6/2003 |
| JP | 2003312898 | | | 11/2003 |
| JP | 2003312898 | A | * | 11/2003 |
| JP | 2007031099 | A | * | 2/2007 |

* cited by examiner

SHEET-CONVEYING DEVICE

BACKGROUND OF THE INVENTION

1. Field of the Invention

The present invention relates to a sheet-conveying device for conveying a sheet material, such as for example a sheet of paper, an envelope, or a postcard, to an image-forming apparatus, such as a printer and a copy machine.

2. Description of the Related Art

In general, many sheet-conveying devices have a skew correction function. When a sheet is skewed, the sheet is conveyed at an angle with respect to a conveying direction of the sheet due to insufficient paper feed accuracy of a sheet-conveying device. In image-forming apparatuses, the skew of the sheet causes paper jams or degradation of print quality. FIG. 7 shows a typical known structure used for skew correction.

Referring to FIG. 7, the structure includes a conveying roller 502 that tries to convey a sheet 505 in a conveying direction 50A and a roller 503 that is disposed so as to face the conveying roller 502 and that is inclined with respect to the conveying direction 50A. The inclined roller 503 and the conveying roller 502 convey the sheet 505 while nipping the sheet 505 therebetween. A reference surface 501 is provided on a side of a conveying path. The reference surface 501 is parallel to the conveying direction 50A and is perpendicular to a plane along which the sheet 505 is conveyed. A member including the reference surface 501 has a shape like a wall or a projection so that an edge of the sheet 505 can come into contact with the reference surface 501. Accordingly, the member including the reference surface 501 serves as a guide that defines a reference position in the width direction of the conveying path and that guides the sheet 505 in the conveying direction 50A.

A skew correction process performed by the above-described structure will be explained below. When the sheet 505 is conveyed in an inclined orientation, the sheet 505 is conveyed in an inclined direction by the inclined roller 503. The sheet 505 conveyed in the inclined direction comes into contact with the wall that defines the reference position at an edge thereof, and the inclination of the sheet 505 is corrected as the sheet 505 is conveyed. Accordingly, the orientation of the sheet 505 is adjusted such that the edge of the sheet 505 extends along the wall. Since the reference surface 501 is provided to cause the sheet 505 to come into contact therewith, the reference surface 501 is hereafter called a contact surface 501.

After the orientation is adjusted, the sheet 505 is conveyed along the contact surface 501. Accordingly, the skew of the sheet 505 is corrected and the position of the sheet 505 in the width direction of the conveying path is determined. This structure is simpler and provides higher reliability compared to the case in which the paper feed accuracy is improved.

Two examples of known sheet-conveying devices will be described below with reference to published patent applications. As a first example, Japanese Patent Laid-Open No. 8-208075 discloses a sheet-conveying device including a contact surface fixed at a side of a sheet conveying path, a conveying roller, and an inclined roller, similar to the above-described structure. In this device, when it is detected by a sensor that a sheet is oriented straight after the sheet is caused to come into contact with the contact surface, the inclined roller is removed from the position where the inclined roller is in pressure contact with the sheet. Accordingly, the sheet can be conveyed without being influenced by the inclined roller.

As a second example, Japanese Patent Laid-Open No. 7-334630 discloses a sheet-conveying device that has a structure similar to the above-described structure but performs a characteristic operation before skew correction. More specifically, a plurality of sensors are provided above a sheet conveying path to detect the amount of inclination of a sheet, and the skew of the sheet is corrected by one of two methods depending on the detected amount of inclination. In a first method, unlike the above-described case, skew correction is performed while an inclined roller is separated from the sheet. More specifically, rollers are arranged at positions spaced from each other in a sheet-conveying direction and the inclination of the sheet is corrected by deflecting the sheet with the rollers such that the leading edge of the sheet comes into contact with a nip portion of the rollers. In a second method, the inclined roller is brought into pressure contact with the sheet and skew correction is performed using the inclined roller and a contact surface, similar to the above-described case.

In the above-described known devices, it is assumed that the sheet is conveyed in only one direction. In addition, whether or not to perform the skew correction is selected by either bringing the inclined roller into pressure contact with the sheet or separating the inclined roller from the sheet. In addition, the contact surface is fixed to the conveying path. For these reasons, the above-described known devices have the following problems.

That is, when, for example, the skew correction is not performed and the sheet is conveyed while the inclined roller is separated from the sheet, the width of the conveying path is limited since the contact surface is fixed to the conveying path. Therefore, when the sheet is conveyed in both forward and reverse directions as disclosed in Japanese Patent Laid-Open No. 2000-326531, the sheet comes into contact with the contact surface in the manner shown in FIG. 9. In addition, when the sheet is rotated on the conveying path as disclosed in Japanese Patent Laid-Open No. 5-213487, the sheet comes into contact with the contact surface in the manner shown in FIG. 10. Therefore, there is a risk that the contact surface 501 will obstruct the operations other than skew correction.

Accordingly, when the contact surface is fixed to the conveying path as described above, operations other than skew correction, such as two-way conveyance and rotation, cannot be performed.

Although the two-way conveyance and rotation of the sheet can be achieved when the width of the conveying path is increased or an additional conveying path is provided so that the sheet can be prevented from coming into contact with the contact surface, the size of the device is increased in such a case.

In addition, when the device is structured such that the inclined roller can move in the vertical direction so that the inclined roller can be separated from the conveying roller, the inclined roller must be supported in a movable manner while the contact surface is fixed to the conveying path. Therefore, as shown in FIG. 8, a supporting member 504 of the inclined roller 503' is deflected when a reaction force is applied from the sheet. Accordingly, the position of the inclined roller 503 is shifted, which degrades the accuracy and reliability of the operation. In order to prevent this deflection, a material with high rigidity must be used.

SUMMARY OF THE INVENTION

In light of the above-described situation, an embodiment of the present invention is directed to a sheet-conveying device that allows two-way conveyance and rotation of a sheet on the same conveying path as a conveying path for skew correction of the sheet. In addition, another embodiment of the present invention is directed to a sheet-conveying device including an inclined roller and a contact surface that are integrated with each other to increase the rigidity thereof so that the accuracy of skew correction can be increased.

According to at least one embodiment of the present invention, a sheet-conveying device includes a sheet conveying path along which a sheet is conveyed in a predetermined direction in use; a conveying roller that is rotatably supported at a position adjacent the sheet conveying path; an inclined roller that is rotatably supported at a position adjacent the sheet conveying path so as to face the conveying roller across the sheet conveying path; an inclined-roller-supporting member that supports the inclined roller such that the inclined roller can rotate about a rotational axis that is inclined with respect to a rotational axis of the conveying roller, the inclined-roller-supporting member being capable of moving between a pressure contact position where the inclined roller comes into pressure contact with the conveying roller and a separate position where the inclined roller is separated from the conveying roller; and a sheet contact member having a contact surface with which an edge portion of a sheet conveyed along the sheet conveying path comes into contact, the sheet contact member being moveable between a contact position where the contact surface projects into the sheet conveying path so that an edge portion of a sheet can come into contact with the contact surface in use, and a withdrawn position where the contact surface is removed from the sheet conveying path so that the contact surface cannot restrict the position of the edge portion of the sheet.

The sheet-conveying device may include a control unit that controls the positions of the inclined-roller-supporting member and the sheet contact member such that the sheet contact member is at the contact position when the inclined-roller-supporting member is at the pressure contact position and the sheet contact member is at the withdrawn position when the inclined-roller-supporting member is at the separate position.

In addition, the inclined-roller-supporting member and the sheet contact member may be integrated with each other.

In the above-mentioned sheet-conveying device, the inclined roller and the contact surface can be removed from the conveying path so that conveying operations other than skew correction, such as two-way conveyance and rotation, can be performed on the same conveying path as the conveying path for skew correction without increasing the size of the conveying path. Accordingly, it is not necessary to use a plurality of conveying paths and space can be saved.

In addition, since the length of the conveying path can be reduced, the conveying speed can be increased as a result. In addition, when the inclined roller and the contact surface are integrated with each other, the reaction force applied from the sheet in the process of skew correction can be canceled. Accordingly, the inclined roller and the contact surface can be prevented from being shifted and the positioning accuracy can be increased.

Since the positioning accuracy can be increased, the print quality can also be increased. In addition, when the contact surface is completely removed from the conveying path, the edge portion of the sheet does not come into contact with the contact surface. Accordingly, the edge portion of the sheet is prevented from being bent or deformed and damage of the sheet can be prevented.

Further features of the present invention will become apparent from the following description of exemplary embodiments with reference to the attached drawings.

DESCRIPTION OF THE EMBODIMENTS

According to at least one embodiment of the present invention, a sheet-conveying device includes a sheet conveying path along which a sheet is conveyed in a predetermined direction; a conveying roller that is rotatably supported at a position adjacent to the sheet conveying path; an inclined roller that is rotatably supported at a position adjacent to the sheet conveying path so as to face the conveying roller across the sheet conveying path; an inclined-roller-supporting member that supports the inclined roller such that the inclined roller can rotate around a rotational axis that is inclined with respect to a rotational axis of the conveying roller, the inclined-roller-supporting member being capable of moving between a pressure contact position where the inclined roller comes into pressure contact with the conveying roller and a separate position where the inclined roller is separated from the conveying roller; and a sheet contact member having a contact surface with which an edge portion of the sheet conveyed along the sheet conveying path comes into contact, the sheet contact member being capable of moving between a contact position where the contact surface projects into the sheet conveying path so that the edge portion of the sheet can come into contact with the contact surface and a withdrawn position where the contact surface is removed from the sheet conveying path so that the contact surface cannot restrict the position of the edge portion of the sheet.

Embodiments of the present invention will be described in detail below.

First Embodiment

Figure 1A:
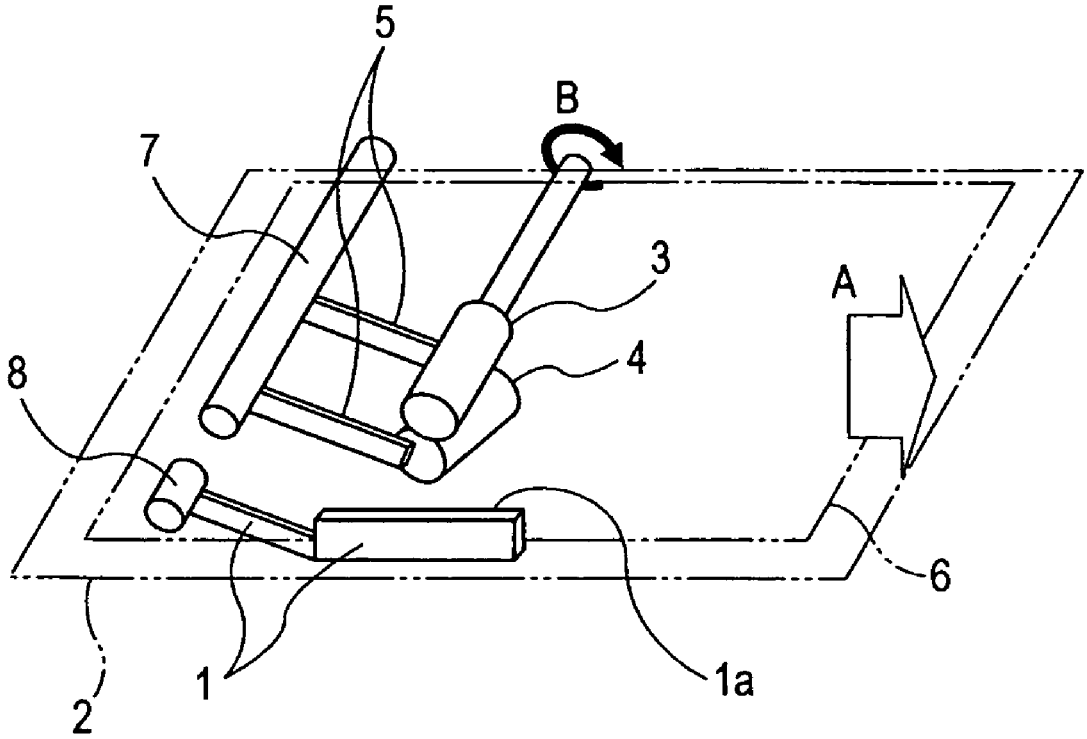
FIGS. 1A and 1B are diagrams illustrating the overall structure according to a first embodiment of the present invention.
Figure 1B:
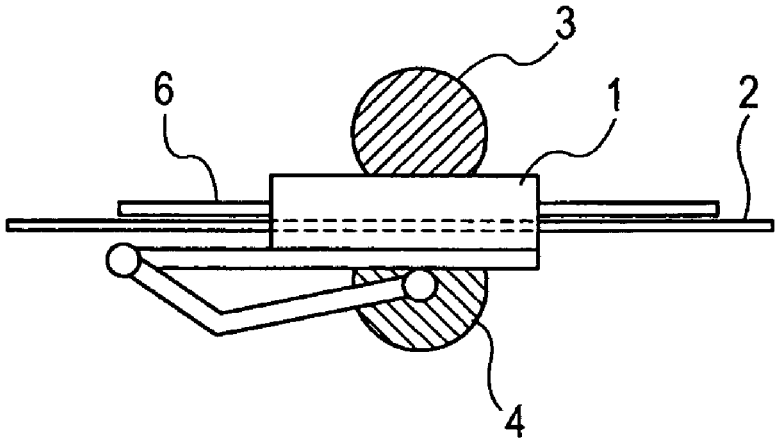
Figure 6:
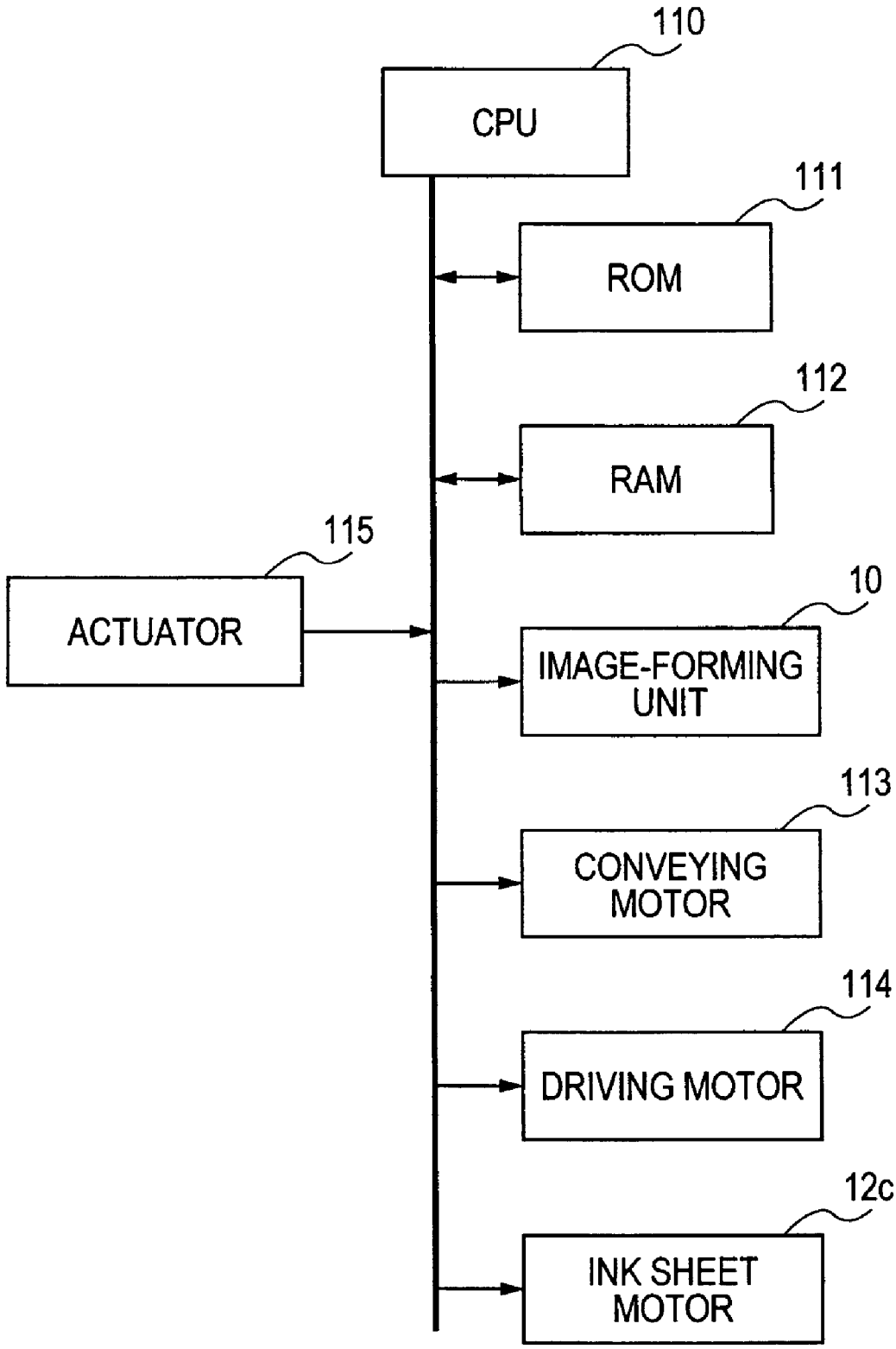
FIG. 6 illustrates a circuit block diagram common to the embodiments of the present invention.
Figure 7:
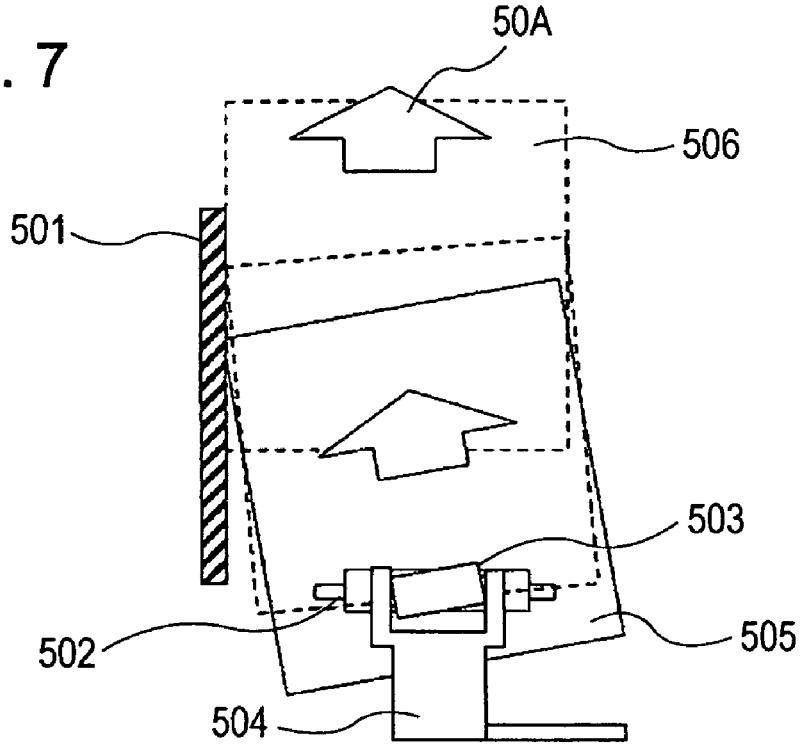
FIG. 7 is a diagram illustrating a typical known structure for skew correction using an inclined roller and a contact surface.
Figure 8:
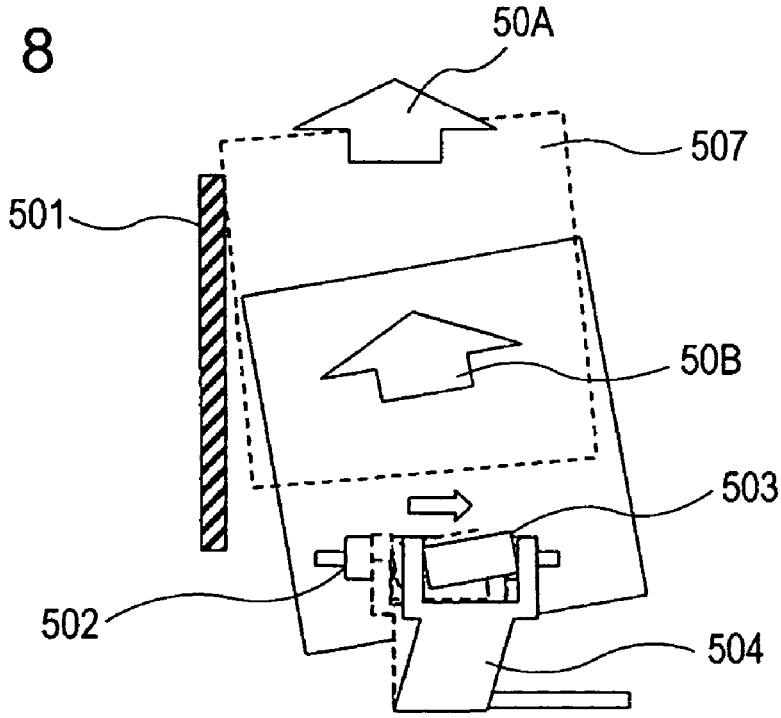
FIG. 8 is a diagram illustrating the manner in which the inclined roller is shifted due to reaction force in the known structure.
Figure 9:
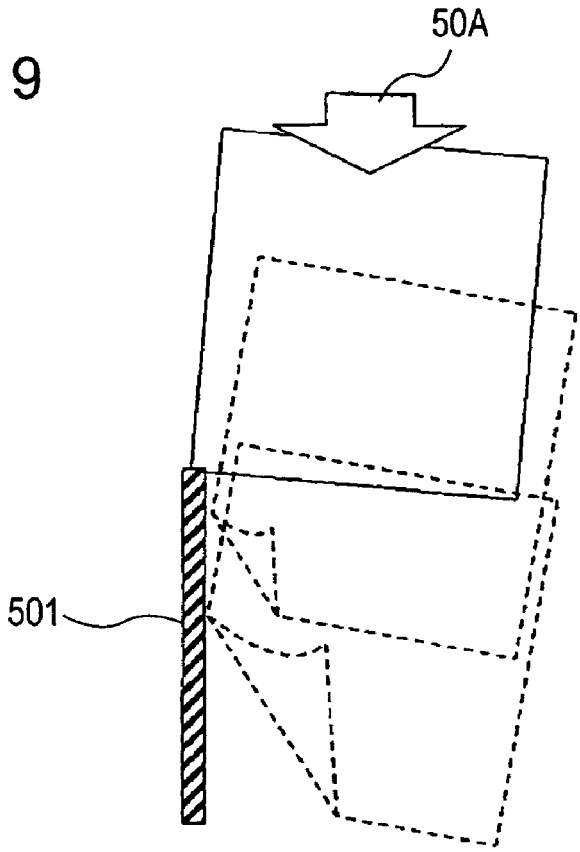
FIG. 9 is a diagram illustrating the manner in which a sheet comes into contact with the contact surface when the sheet is conveyed in the reverse direction in the known structure.
Figure 10:
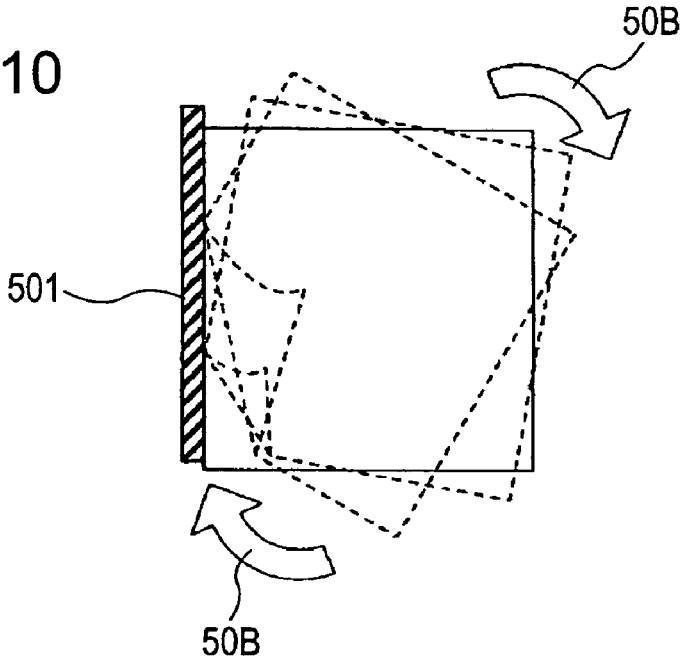
FIG. 10 is a diagram illustrating the manner in which the sheet comes into contact with the contact surface when the sheet is rotated in the known structure.

FIGS. 1A and 1B illustrate the overall structure according to a first embodiment. FIG. 1A illustrates a perspective view of the structure. FIG. 6 illustrates a circuit block diagram common to each of the embodiments. A sheet 6 is placed in a sheet conveying path 2, and is conveyed in a conveying direction shown by the arrow A. FIG. 1B illustrates a side view of FIG. 1A.

Figure 2A:
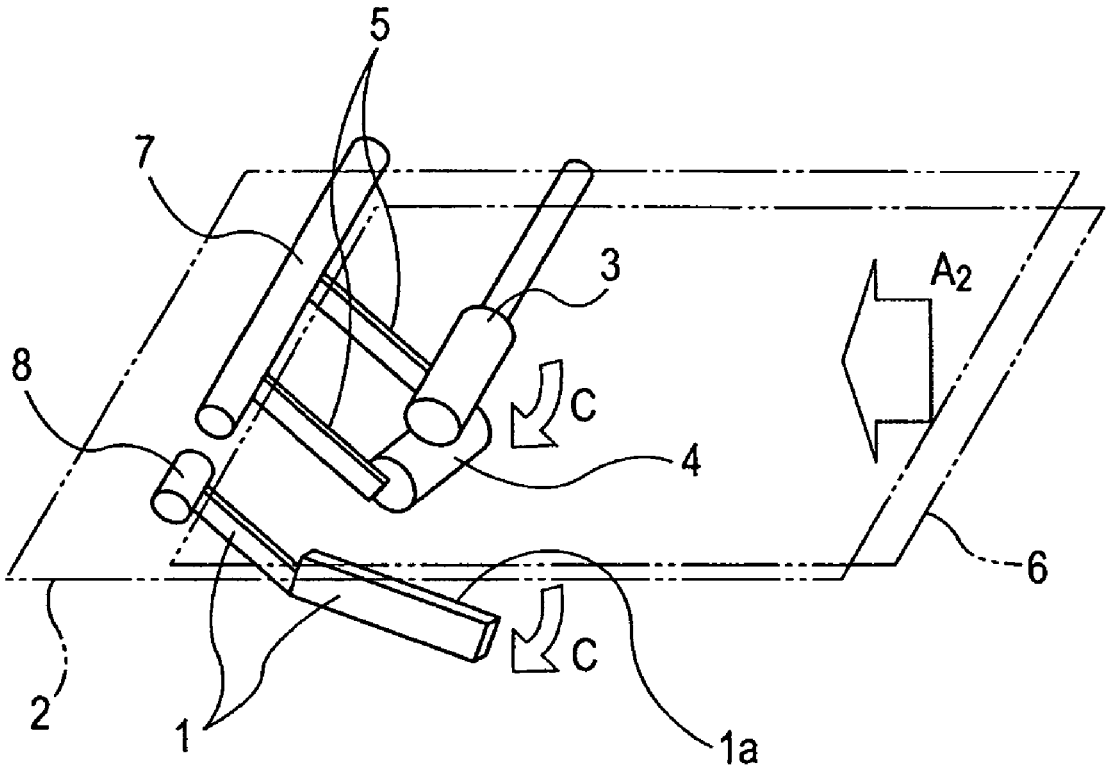
FIGS. 2A and 2B are supplementary diagrams illustrating the overall structure according to first embodiment.
Figure 2B:
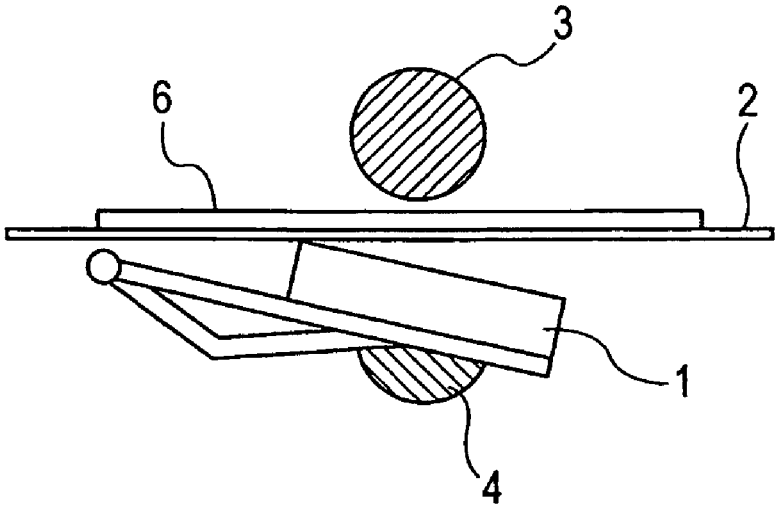

In FIGS. 1A and 1B, a contact member 1 that functions as a restricting member has a contact surface 1*a* and serves a skew correction function similar to that of the known structure. In addition, the contact member 1 has a shaft 8 that supports the contact member 1 in such a manner that the contact member 1 can rotate around the shaft 8. When the skew correction is performed, the contact member 1 is placed such that the contact surface 1*a* is at a contact position where the contact surface 1*a* interferes with the sheet 6. When the skew correction is not performed, an actuator 115 (driving means), such as a solenoid, rotates the contact member 1 around the shaft 8 in the direction shown by the arrow C in FIG. 2A, so that the contact surface 1*a* is moved to a withdrawn position below the conveying surface 2 where the contact surface 1*a* does not interfere with the sheet 6. The actuator 115 functions as moving means.

A conveying roller 3 is rotatably supported at a position adjacent to the sheet conveying path 2, and is rotated by a conveying motor 113 (driving means) to apply a conveying force to the sheet 6. An inclined conveying roller 4 is rotatably supported so as to face the conveying roller 3. The inclined conveying roller 4 functions as inclined conveying means. A rotating shaft of the inclined conveying roller 4 is at an angle with respect to a rotating shaft of the conveying roller 3. The inclination angle of the rotating shaft of the inclined conveying roller 4 is set such that an edge of the sheet 6 comes into contact with the contact surface 1*a* when the sheet 6 is conveyed in an inclined direction. The rotating shaft of the inclined conveying roller 4 is supported by supporting members 5 that can be rotated around a shaft 7 by the driving means (not shown) so as to move the inclined conveying roller 4 between a pressure contact position where the inclined conveying roller 4 can come into pressure contact with the conveying roller 3 and a separate position where the inclined conveying roller 4 is separated from the conveying roller 3.

Next, the operation of the sheet-conveying device will be described below. When the sheet 6 enters the conveying path 2 while the contact surface 1*a* is on the conveying path 2 and the inclined conveying roller 4 is in pressure contact with the conveying roller 3, the sheet 6 is nipped between the conveying roller 3 and the inclined conveying roller 4 and is conveyed in an inclined direction by the conveying force of the conveying roller 3 and the inclined conveying force of the inclined conveying roller 4. As the sheet 6 is conveyed in the inclined direction, a side edge thereof gradually approaches the contact surface 1*a*. After the side edge of the sheet 6 comes into contact with the contact surface 1*a*, the sheet 6 is conveyed in the conveying direction A while changing the orientation thereof. The orientation of the sheet 6 is adjusted such that the side edge of the sheet 6 extends along the contact surface 1*a*, and accordingly skew correction and positioning of the sheet 6 in the lateral direction are performed. This operation is similar to that of the above-described known structure.

Next, an image-recording apparatus according to Japanese Patent Laid-Open No. 2000-326531 in which a sheet is conveyed in opposite directions for printing will be described as an example. In this apparatus, the sheet 6 is conveyed in the forward and reverse directions along the same conveying path. Printing is performed while the sheet 6 is moved in the forward direction and the sheet 6 is simply conveyed when the sheet 6 is moved in the reverse direction. The skew correction is performed before printing so that the sheet 6 is oriented straight, and then an image of a first color is printed. Then, the sheet 6 is moved in the reverse direction along the same conveying path, and an image of a second color is printed. Since the skew correction is not performed when the sheet 6 is moved in the reverse direction, the inclined conveying roller 4 is moved to the separate position so as to eliminate the influence of the inclined conveying roller 4. If the sheet 6 is slightly shifted in the lateral direction when the sheet 6 is moved in the reverse direction, there is a possibility that the sheet 6 will come into contact with the contact surface 1*a* (or with an edge of the contact member) and the contact surface 1*a* will obstruct the movement of the sheet 6. In order to prevent this, when the sheet 6 is moved in the reverse direction, the contact surface 1*a* is moved to the withdrawn position below the conveying path 2, as shown by the arrow C in FIG. 2A. Accordingly, the sheet 6 can be reliably conveyed even when there is a possibility that the sheet 6 will be slightly shifted when the sheet 6 is moved in the reverse direction.

Thus, the skew correction function can be switched off by moving the contact surface 1*a* and the inclined conveying roller 4 to the withdrawn position and the separate position, respectively. When the contact surface 1*a* and the inclined conveying roller 4 are moved to the withdrawn position and the separate position, respectively, so that the skew correction function is switched off, the sheet 6 can be moved in the opposite directions or rotated in the same conveying path 2. Accordingly, the size of the conveying path 2 can be reduced, which leads to a reduction in the size of the sheet-conveying device.

Second Embodiment

Figure 4:
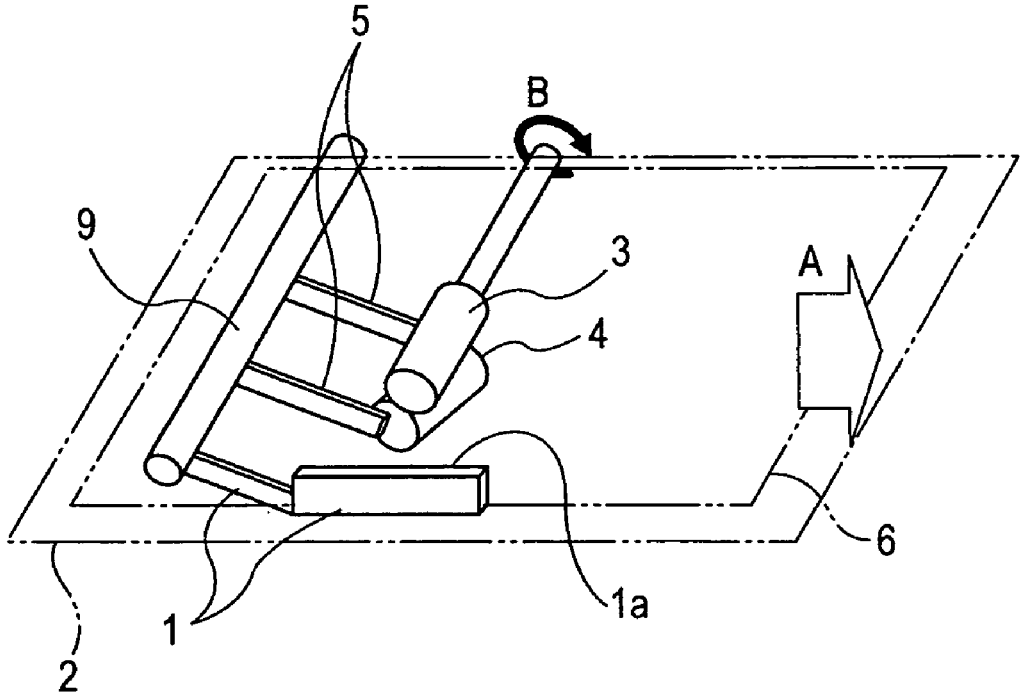
FIG. 4 is a diagram illustrating the overall structure according to a second embodiment of the present invention.

FIG. 4 illustrates the structure according to a second embodiment. In the second embodiment, a conveying roller 3, an inclined conveying roller 4, and a conveying surface 2 are similar to those of the first embodiment. The second embodiment differs from the first embodiment in that a contact member 1 is integrated with supporting members 5 of the inclined conveying roller 4 and the integrated body is rotatably supported by a shaft 9. The shaft 9 is supported such that the solenoid 115 (driving means) can rotate the shaft 9 so as to move the contact surface 1*a* and the inclined conveying roller 4 to a withdrawn position and a separate position, respectively, at the same time.

Next, the operation of the sheet-conveying device according to the second embodiment will be described below. Although the processes in which skew correction is performed and not performed are the same as those in the first embodiment, the influence of a reaction force applied from the sheet 6 when the skew correction is performed is different from that of the first embodiment.

Figure 3:
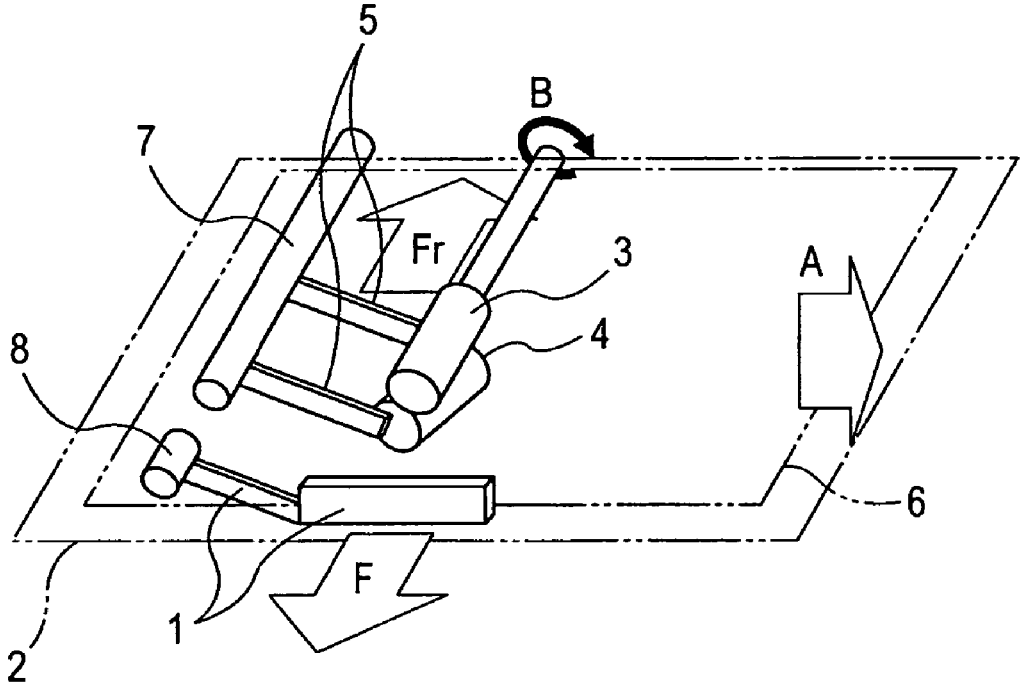
FIG. 3 is a diagram illustrating a reaction force according to the first embodiment.

In the first embodiment, the inclined conveying roller 4 causes the sheet 6 to push the contact surface 1*a* by a force shown by the arrow F in FIG. 3. The inclined conveying roller 4 receives a reaction force shown by the arrow Fr in FIG. 3 from the sheet 6. Accordingly, there is a possibility that the inclined conveying roller 4 will be moved from a predetermined position by the reaction force Fr, and it is necessary to use a material with sufficiently high rigidity to prevent the contact member 1 and the inclined conveying roller 4 from being moved. The second embodiment overcomes this disadvantage.

As shown in FIG. 4, in the second embodiment, the contact member 1 and the supporting members 5 of the inclined conveying roller 4 are both fixed to the shaft 9 and are integrated with each other. Therefore, even when the contact member 1 and the inclined conveying roller 4 receive the reaction force from the sheet 6 in the process of skew correction, the reaction force F functions as an internal force in a single rigid body. Accordingly, the positions of the contact surface 1*a* and the inclined conveying roller 4 can be accurately maintained even when the reaction force is applied from the sheet 6. In addition, since the contact member 1 is integrated with the supporting members 5 of the inclined conveying roller 4, the contact surface 1*a* and the inclined conveying roller 4 can be moved together with a simple mechanism. Therefore, in addition to the effects obtained by the first embodiment, the skew correction can be performed with high accuracy using a simple mechanism and the skew correction function can be easily switched on and off.

Figure 5:
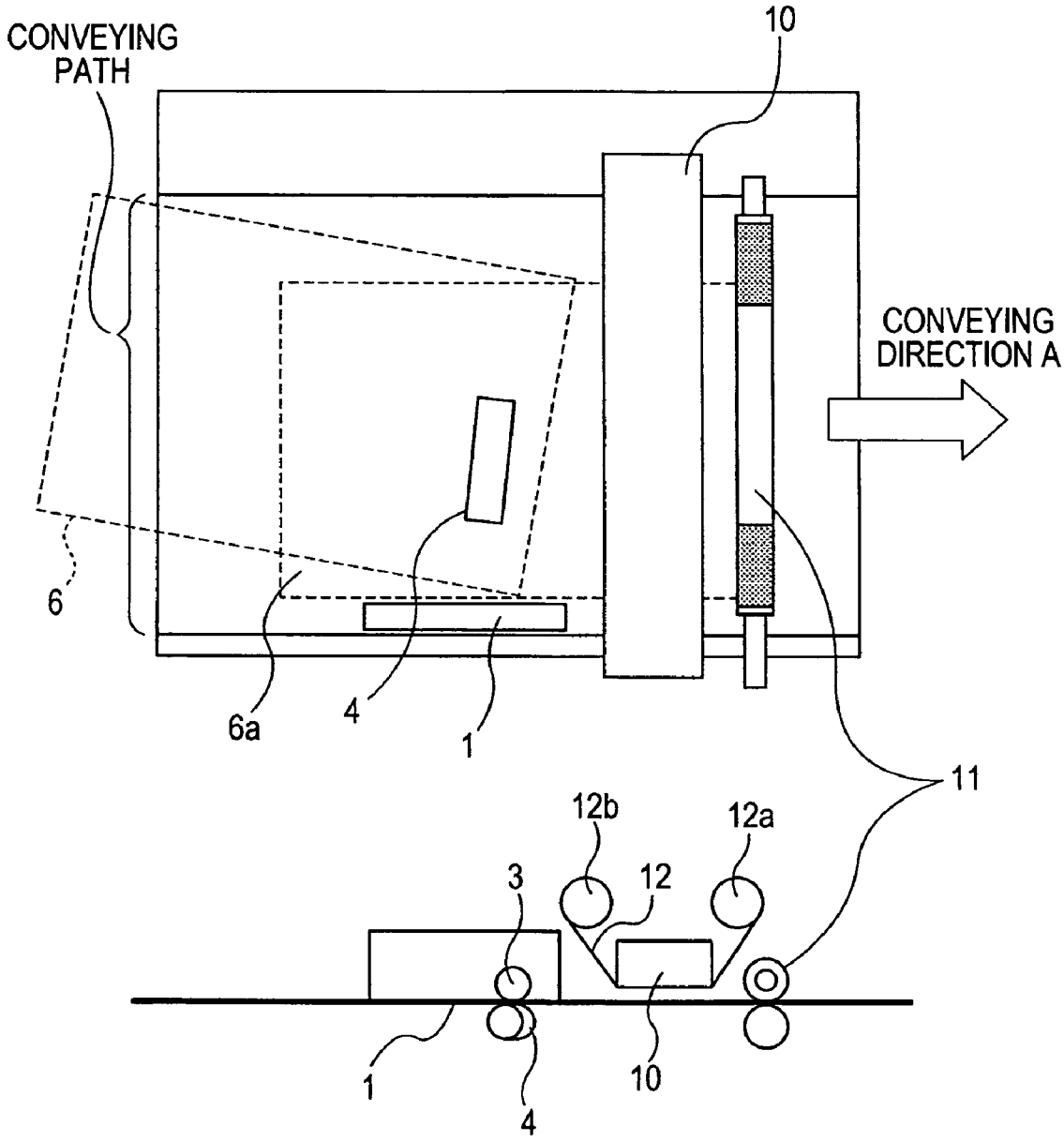
FIG. 5 is a diagram illustrating the overall structure of a recording apparatus incorporating an embodiment of the present invention.

FIG. 5 illustrates an image-recording apparatus including the structure according to the first embodiment or the second embodiment.

FIG. 6 illustrates a circuit block diagram. In FIG. 6, reference numeral 110 denotes a central processing unit (CPU) that controls a conveying motor 113, a driving motor 114, an ink sheet motor 12*c*, an image-forming unit 10, such as a recording head, and the actuator 115. In addition, reference numeral 111 denotes a read only memory (ROM) that stores control data and the like and reference numeral 112 denotes a random access memory (RAM) that serves as an area for expanding recording data and the like.

Inks of different colors, such as yellow, magenta, and cyan, are successively applied to an ink sheet 12. The ink sheet 12 is fed from a feed roller 12*b* and is wound around a take-up roller 12*a* that functions as take up means. The recording head (thermal head) 10 transfers the ink on the ink sheet 12 onto the sheet 6 by heat. A pair of drive rollers 11 convey the sheet 6 in forward and reverse directions. The drive rollers 11 are driven by the driving motor 114 to function as conveying means.

The sheet 6 is conveyed in the conveying direction A by the conveying roller 3 and the inclined conveying roller 4, and comes into contact with the contact member 1 so that the skew of the sheet 6 is corrected. When the sheet 6 is nipped between the drive rollers 11 after the skew correction, the actuator 115 moves the inclined conveying roller 4 and the contact member 1 in a direction perpendicular to the surface of the sheet 6 (i.e., in the thickness direction of the sheet 6). After the inclined conveying roller 4 and the contact member 1 are moved to positions where they do not come into contact with the sheet 6, the recording sheet 6 is conveyed in the conveying direction A by the drive rollers 11. At the same time, the ink sheet motor 12*c* rotates the take-up roller 12*a* counterclockwise so that the ink sheet 12 is wound around the take-up roller 12*a*.

Then, image recording is started when the sheet 6 reaches a recording start position 6*a*. More specifically, the yellow ink, which is the ink of a first color that is applied to the ink sheet 12, is transferred onto the sheet 6 by heating elements that are included in the recording head 10 and that generate heat in accordance with an image signal while the sheet 6 is being moved. Accordingly, a yellow image is formed on the sheet 6.

After the image of the first color is formed, the sheet 6 is conveyed by the drive rollers 11 in a direction opposite to the direction A, passes through a region corresponding to the contact member 1, and returns to the recording start position 6*a*. Thus, the sheet 6 that returns to the recording start position 6*a* is moved through a region where the position thereof is restricted by the contact member 1. In other words, the sheet 6 that returns to the recording start position 6*a* passes by the contact member 1 or passes through a position where the sheet 6 comes into contact with the contact member 1. However, since the contact member 1 is beforehand moved away from the conveying path, the sheet 6 does not come into contact with the contact member 1. The ribbon motor 12*c* drives the take-up roller 12*a* and winds the ink sheet 12 until a region of magenta, which is a second color, faces the recording head 10. Then, the sheet 6 is conveyed in the conveying direction A by the conveying rollers 11 and a magenta image is formed on the sheet 6 by the recording head 10. Then, a cyan image is similarly transferred onto the sheet 6 and the image-forming operation is finished.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-080776 filed Mar. 22, 2005, which is hereby incorporated by reference herein in its entirety.

What is claimed is:

1. A recording apparatus comprising:

a sheet conveying device comprising:

a sheet conveying path along which a sheet is conveyed in a predetermined direction in use;

a conveying roller that is rotatably supported at a position adjacent the sheet conveying path;

an inclined roller that is rotatably supported at a position adjacent the sheet conveying path so as to face the conveying roller across the sheet conveying path;

an inclined-roller-supporting member that supports the inclined roller such that the inclined roller can rotate about a rotational axis that is inclined with respect to a rotational axis of the conveying roller, the inclined-roller-supporting member being capable of moving between a pressure contact position where the inclined roller comes into pressure contact with the conveying roller and a separate position where the inclined roller is separated from the conveying roller; and a sheet contact member having a contact surface with which an edge portion of a sheet conveyed along the sheet conveying path comes into contact, the sheet contact member being moveable between a contact position where the contact surface projects into the sheet conveying path so that an edge portion of a sheet can come into contact with the contact surface in use, and a withdrawn position where the contact surface is removed from the sheet conveying path so that the contact surface cannot restrict the position of the edge portion of the sheet;

two-way conveying means that is positioned downstream of the sheet conveying device for conveying the sheet on the conveying path in opposite directions;

a recording head that records on the sheet conveyed in the opposite directions by the two-way conveying means by transferring a plurality of kinds of ink onto the sheet;

moving means that moves the sheet contact member to a withdrawn position where the sheet does not come into contact with the sheet contact member when the two-way conveying means conveys the sheet in the opposite directions;

wherein the moving means moves the sheet contact member in the thickness direction of the sheet on the sheet conveying path.

2. The recording apparatus according to claim 1, wherein the sheet conveying device includes:

control means for controlling the positions of the inclined-roller-supporting member and the sheet contact member, such that the sheet contact member is at the contact position when the inclined-roller-supporting member is at the pressure contact position and the sheet contact member is at the withdrawn position when the inclined-roller-supporting member is at the separate position.

3. The recording apparatus according to claim 1, wherein the inclined-roller- supporting member and the sheet contact member are integrated with each other.

4. The recording apparatus according to claim 1, wherein the inclined roller moves to a position where the sheet does not come into contact with the inclined roller when the sheet contact member is moved to the withdrawn position.

5. The recording apparatus according to claim 1, further comprising take-up means that winds an ink sheet.

6. The recording apparatus according to claim 1, wherein the two-way conveying means includes a pair of rollers that convey the sheet while nipping the sheet between the rollers.

7. The recording apparatus according to claim 1, wherein the recording head records on the sheet when the sheet is conveyed downstream by the two-way conveying means.

8. The recording apparatus according to claim 1, wherein a region in which the sheet is conveyed in the opposite directions by the two-way conveying means includes a region corresponding to the sheet contact member.

* * * * *